United States Patent [19]

Kojima

[11] Patent Number: 4,963,855

[45] Date of Patent: Oct. 16, 1990

[54] WARNING SOUND GENERATING DEVICE

[75] Inventor: Yoshikazu Kojima, Urawa, all of Japan

[73] Assignee: Kobishi Electric Co., Inc. Ltd., Tokyo, Japan

[21] Appl. No.: 483,258

[22] Filed: Feb. 21, 1990

[51] Int. Cl.[5] ..... G08B 13/00

[52] U.S. Cl. ..... 340/391; 340/388; 340/405; 181/187; 381/159

[58] Field of Search ..... 340/388, 391, 404, 405, 340/406, 984, 985, 691, 693; 381/188, 205, 153, 159; 181/187, 188, 189, 190, 198

[56] References Cited

U.S. PATENT DOCUMENTS

| | | | |
|---|---|---|---|
| 2,537,141 | 1/1951 | Rlipsch | 181/187 |
| 4,187,926 | 2/1980 | Henricksen et al. | 181/187 |
| 4,310,833 | 1/1982 | Sakaguchi | 340/388 |
| 4,487,590 | 7/1989 | Gosswiller | 340/405 |
| 4,633,229 | 12/1986 | Iacano e tal. | 340/391 |
| 4,700,178 | 10/1987 | Shimoya | 340/388 |

FOREIGN PATENT DOCUMENTS

| | | |
|---|---|---|
| 430025 | 6/1935 | United Kingdom . |
| 566398 | 12/1944 | United Kingdom . |
| 1480414 | 7/1977 | United Kingdom . |
| 2094099 | 10/1981 | United Kingdom . |
| 2073541 | 7/1983 | United Kingdom . |
| 2145905 | 5/1987 | United Kingdom . |

*Primary Examiner*—Donnie L. Crosland
*Attorney, Agent, or Firm*—Joseph S. Iandiorio

[57] ABSTRACT

A warning sound generating device includes a sound source member and an enclosure for protecting the sound source member. A front wall of the enclosure and a sound emitting portion of the sound source member face each other. The front wall of the enclosure has at least one continuous projecting wall extending toward the sound source member. The sound source member has at least one continuous projecting wall extending toward the enclosure and surrounding the sound emitting portion. The enclosure has a plurality of sound exits formed outwardly from the outermost projectng wall of the enclosure. The projecting walls of the sound source member and the enclosure cooperate to define a sound passageway through which a sound generated from the sound emitting portion passes. Each of the projecting walls has a thickness decreasing from the base to the forward rim thereof, so that the passageway has a width between the projecting walls increasing from the sound emitting portion to the sound exits.

5 Claims, 5 Drawing Sheets

WARNING SOUND GENERATING DEVICE

BACKGROUND OF THE INVENTION

The present invention relates to a warning sound generating device, and especially to an emergency warning siren device for a fire alarm.

As prior art of the present invention, the following documents may be cited: U.S. Pat. No. 4,310,833, U.K. Pat. No. 2,145,905B, U.K. Pat. No. 2,094,099A, U.K. Pat. No. 2,073,541B, U.K. Pat. No. 1,480,414, U.K. Pat. No. 566,398, U.K. Pat. No. 430,025, and Elements of Acoustical Engineering-Olson (D. Van Nostrand Co. Inc.) 2nd Edition Reprinted, March 1949 (See page 211, FIG. 7.21).

U.K. Pat. No. 2,145,905B discloses an electric siren. The siren comprises a base mounted on a sound generating means, and a plurality of horn members disposed coaxially and attached to the base. The horn members opening forward and another horn member opening backward (toward the base) are radially alternatingly disposed on the base. Consequently, a folded and broadening sound passageway are defined by the horn members. With such a construction, the generated sound spreads widely and is broadcast over a long distance. Since the sound passageway is folded, if the length of the whole siren is short, a long sound passageway can be provided.

However, in the production of the siren, a plurality of the horn members are mounted on the base one by one, and therefore the efficiency of assembly is not improved.

In addition, the structure is such that the horn member opening backward may not be stably supported by the base, so that the horn member is of inferior strength.

Furthermore, it is considered to be difficult to make the entire siren compact and to make the sound passageway long if the number of folds is kept constant.

SUMMARY OF THE INVENTION

It is therefore an object of the present invention to provide a warning sound generator in which the number of the components or elements is decreased, and thus in which efficiency of assembly is high.

It is another object of the invention to provide a warning sound generator which is of a strong construction.

Another object of the invention is to provide a warning sound generator of a small size while the sound passageway is elongated even if the number of folds of the passageway is limited.

For the above purpose, the warning sound generating device of the present invention comprises a sound-source-member for generating a warning sound and an enclosure secured to the sound-source-member for containing and protecting the sound-source-member.

The sound-source-member has a planar base plate and at least one continuous sound-source-member projecting wall extending from a surface of the base plate. The sound-source-member projecting wall has a forward rim. The planar base plate has a sound emitting portion surrounded by the projecting wall.

The enclosure includes a front wall having an inner surface facing generally parallel to the surface of the planar base plate from which the sound-source-member projecting wall extends. The enclosure is spaced apart from the forward rim of the sound-source-member projecting wall of the sound-source-member. The enclosure further includes at least one continuous enclosure projecting wall extending from the surface of the front wall toward the base plate of the sound-source-member. The enclosure projecting wall, which has a rearward rim spaced apart from the base plate, is disposed outward of the sound-source-member projecting wall and spaced apart from the sound-source-member projecting wall so as to form a space therebetween. The enclosure has a plurality of sound exits formed outwardly from the enclosure projecting wall, so that there is provided a sound passageway from the sound emitting portion of the sound-source-member through the space between the sound-source-member projecting wall and enclosure projecting wall to sound exits.

With such a construction, the projecting walls, which define the sound passageway, belong to the enclosure or the sound source member. Consequently, the number of the components or elements is less than in any conventional siren or warning sound generator. Thus, in order to provide the sound passageway, the assembling does not require troublesome operations but instead the attaching of the enclosure and the sound-source-member is such that efficiency for assembling is improved.

Furthermore, the enclosure projecting wall, which opens toward the sound-source-member, is mounted on the enclosure unitedly or securely. The warning sound generator is of a strong construction in which undesirable changes of tone of the generated sounds will not occur.

DETAILED DESCRIPTION OF THE PREFERRED EMBODIMENT

A preferred embodiment of the present invention will be described hereinafter with reference to the accompanying drawings.

Figure 9:
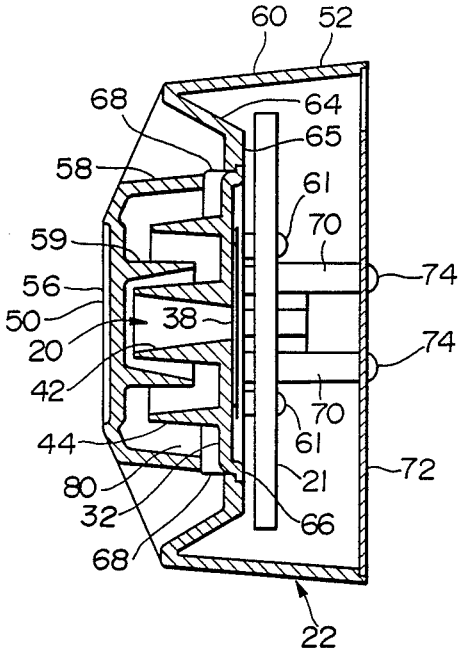
FIG. 9 is a view taken along line IX—IX of FIG. 1.

As shown in FIG. 9, a sound generating device according to the present invention, which is for the production of emergency warning sounds, comprises a sound-source-member 20, a sound generating circuit 21 for actuating the sound-source-member 20, and an enclosure 22 for containing and protecting the sound-source-member 20 and the sound generating circuit 21.

Figure 1:
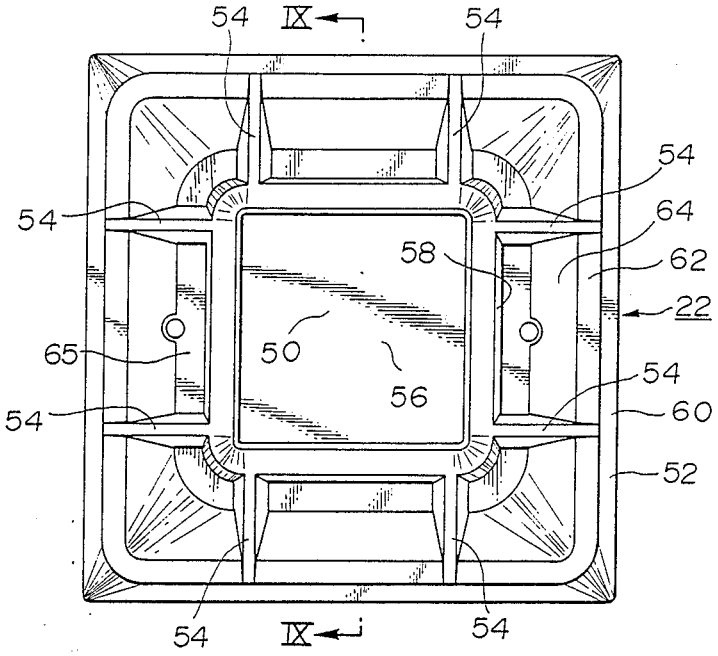
FIG. 1 is a front view of a warning sound generating device according to the present invention.
Figure 2:
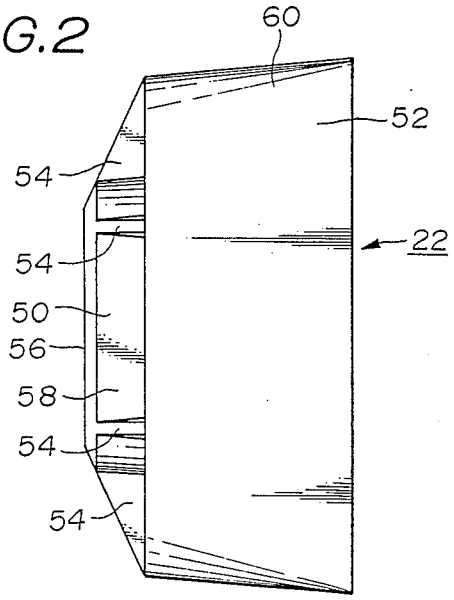
FIG. 2 is a side view of the warning sound generating device in FIG. 1.
Figure 3:
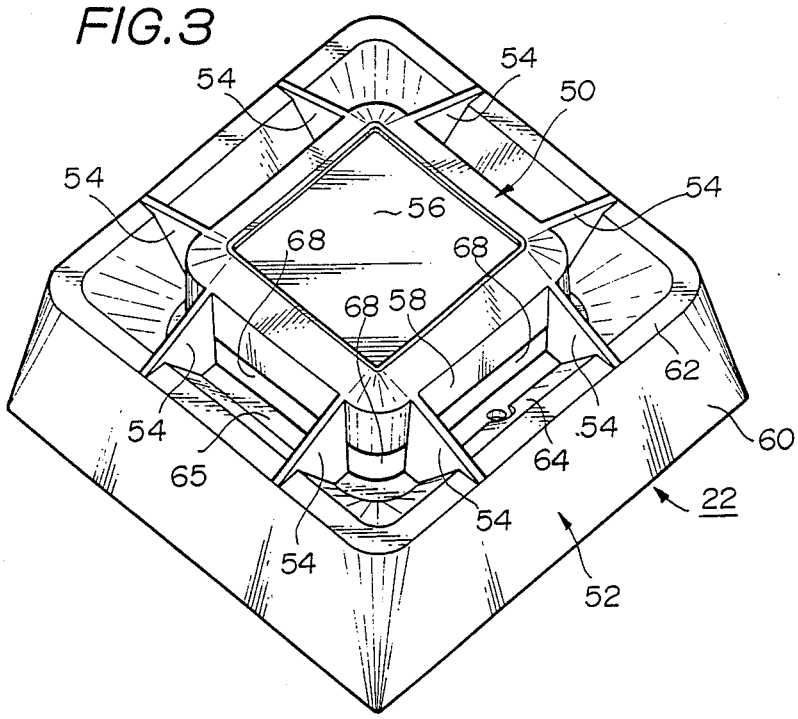
FIG. 3 is a perspective view of the warning sound generating device in FIG. 1.
Figure 4:
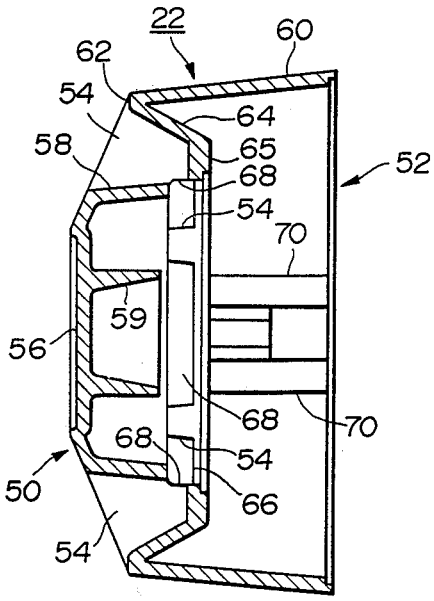
FIG. 4 is an axial-sectional view of an enclosure of the sound generating device in FIG. 1.
Figure 5:
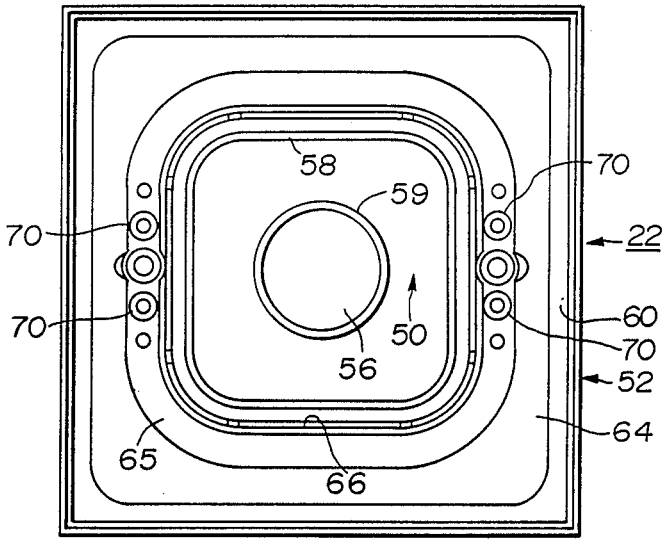
FIG. 5 is a rear view of the enclosure shown in FIG. 4.
Figure 6:
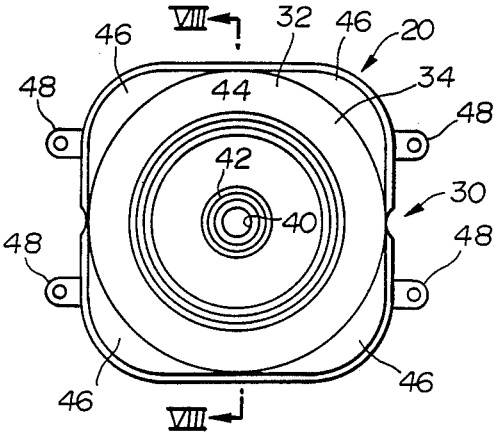
FIG. 6 is a front view of a sound-source-member of the sound generating device in FIG. 1.
Figure 7:
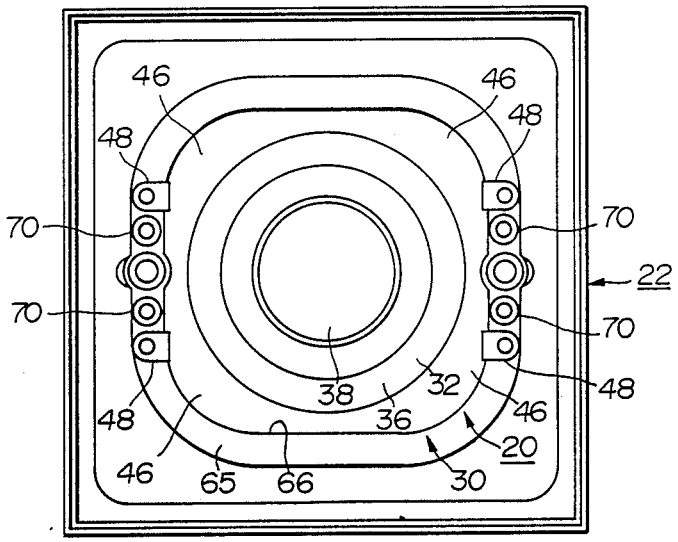
FIG. 7 is a rear view of the enclosure in FIG. 4 with the sound-source-member attached.
Figure 8:
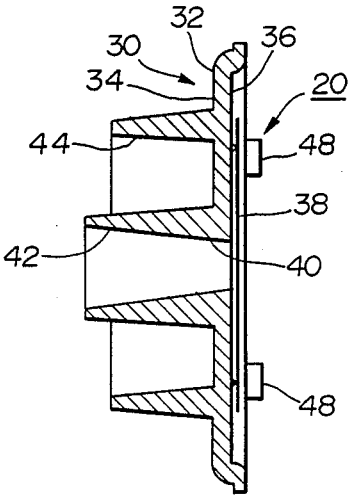
FIG. 8 is a view taken along line VIII—VIII of FIG. 6.

As shown in FIGS. 6 through 8, the sound-source-member 20 comprises a body 30, and a circular piezo-electric element 38 secured on the rear surface 36 of the base plate 32. The piezo-electric element 38 is mounted on the rear surface 36 via a ring of a triangular cross section, so that a narrow uniform space is provided between the piezo-electric element 38 and the rear surface 36. A though-hole 40 of a circular cross section is formed at the center of the base plate 32. The piezo-electric element 38 is secured at the center of the rear surface 36 so as to cover the through-hole 40. Consequently, there is provided a sound emitting portion at the center of the base plate 32, which is exposed through the through-hole 40.

The body 30 further has two continuous sound-source-member projecting walls 42 and 44 of cylindrical shapes, extending generally perpendicularly from the front surface 34 of the base plate 32, and concentric with the base plate 32. The outer sound-source-member projecting wall 44 has a uniform height less than a uniform height of the inner sound-source-member projecting wall 42. Each of the projecting walls 42 and 44 has a thickness gradually decreasing from the front surface 34 to the forward rim thereof.

The body 30 has four brim portions 46 extending radially outwardly from the rear surface 36 so that the body 30 has a generally square profile as viewed in FIG. 6. The body 30 has four joint portions 48 for securing the body 30 to the enclosure 22 with screws.

FIGS. 1 through 5 depict the enclosure 22 of a generally square box-shape, comprising a central cover 50, a peripheral cover 52, and bridges 54 for interconnecting the central cover 50 and the peripheral cover 52.

The central cover 50 is of a generally square box-shape and comprises a front wall 56 of a square configuration and two continuous enclosure projecting walls 58 and 59 concentric to each other. The outer enclosure wall 58, which is disposed radially outward of the inner enclosure wall 59, extends rearward from the edge of the front wall 56. The outer enclosure wall 58 has a generally square profile as viewed in FIGS. 1 and 5, and tapers as it extends from the front wall 56 along the axis of the central cover 50 at a uniform height. The inner enclosure projecting wall 59 is of a cylindrical shape and extends generally perpendicularly from the rear face of the front wall 56. The inner enclosure projecting wall 59 has a uniform height and a thickness gradually decreasing as it extends from the front wall 56.

The peripheral cover 52 is also of a generally square box-shape and comprises an outer lateral wall 60 forming a square shaped enclosure, a front wall 62 extending from the front edge of the outer lateral wall 60 toward the central cover 50, and an inner lateral wall 64 extending from the radially inner edge of the front wall 62 so as to protrude into a space defined by the outer lateral wall 60 and the outer projecting wall 58. The inner lateral wall 64 forms a square enclosure sloping rearward from the front wall 62. The inner lateral wall 64 has a brim portion 65 extending from the rear edge thereof toward the center of the peripheral cover 52. The bridges 54 bridge the brim portion 65 of the inner lateral wall 64 and the outer enclosure wall 58 of the central cover 50 so that the front wall 56 of the central cover 50 projects forward relative to the front wall 62 of the peripheral cover 52.

The peripheral cover 52 has a generally square central opening 66 defined by the brim portion 65 of the inner lateral wall 64, and the central cover 50 is disposed centered over the opening 66 and is encompassed by the inner lateral wall 64. More specifically, the central cover 50 is disposed in front of the opening 66 so as to be axially spaced from the brim portion 65. As a result, there are provided a plurality of sound exits 68 between the outer enclosure wall 58 of the central cover 50 and the brim portion 65 of the peripheral cover 52, the sound exits being partitioned from one another by the plurality of bridges 54. These sound exits 68 open radially outwardly.

As shown in FIGS. 7 and 9, the sound-source-member 20 is secured to the enclosure 22 by screws 61 which pass through the joint portions 48 and engage with threaded-holes formed in the brim portion 65. When fixed in place, the contour of the sound-source-member 20 completely fits in and closes of the opening 66 of the enclosure in such a manner that the base plate 32 of the sound-source-member 20 and the front wall 56 of the central cover 50 face parallel to each other, and all the projecting walls 42, 44, and 59 are concentric to one another.

The projecting walls are disposed so that they are arranged, from the innermost to outermost, in the following order: the sound-source-member wall 42, enclosure wall 59, sound-source-member projecting wall 44, and enclosure wall 58. As previously described, the opening 66 of the peripheral cover 52 of the enclosure 22 is shut by the base plate 32 of the sound-source-member 20. Consequently, there is provided a sound passageway 80, (of concentric ring shaped spaces as seen in a front cross section and forming a zigzag-shaped space as seen in a side cross section) from the sound emitting portion, i.e., the piezo-electric element 38, to the sound exits 68, so that the sound can be transmitted forward of the brim portion 65 of the peripheral cover 52 of the enclosure 22.

As shown in FIGS. 7 and 9, the peripheral cover 52 further has cylindrical projections 70 which extend from the brim portion 65 of the inner lateral wall 64. Each of the cylindrical projections 70 is threaded on the inner surface. On the projections 70, a lid 72 is fastened by screws 74 in order to prevent the sound-source-member 20 and the circuit 21 from being exposed to external contaminants.

The circuit 21 is connected to a direct-current electric power source which is installed outside of the enclosure 22. As shown in FIG. 9, the circuit 22 is connected to the piezo-electric element 38 thereby oscillating the element 38 to emit a warning sound toward the front wall 56 of the center cover 50. The substrate of the circuit 21 together with the sound-source-member 20 are secured to the enclosure 22 by the screws 61.

In the above structure, as shown in FIG. 9, the forward rims of the sound-source-member projecting walls 42 and 44 face the front wall 56 of the central cover 50 in a uniform spaced relation and the rearward rims of the enclosure projecting walls 58 and 59 face the base plate 34 of the sound-source-member 20 in a uniform spaced relation. The outer lateral surface of the inner sound-source-member projecting wall 42 and the inner lateral surface of the inner enclosure projecting wall 59 face each other in a spaced relation and the inner lateral surface of the outer sound-source-member projecting wall 44 and the outer lateral surface of the inner enclosure projecting walls 59 face each other and are spaced from each other. The outer lateral surface of the outer sound-source-member projecting wall 44 is spaced from the outer enclosure wall 58 of the central cover 50 of the enclosure 22.

The width between the inner sound-source-member projecting wall 42 and the enclosure projecting wall 59 is less than the space between the enclosure projecting wall 59 and the base plate 32, and is greater than the space between the inner sound-source-member projecting wall 42 and the front wall 56. The width between the outer sound-source-member projecting wall 44 and the enclosure projecting wall 59 is less than the space between the outer sound-source-member projecting wall 44 and the front wall 56, and is greater than the space between the enclosure projecting wall 59 and the base plate 32. Since the outer enclosure wall 58 has a square shape and the inner enclosure 59 has a cylindrical shape, the smallest width between the inner lateral surface of the outer enclosure wall 58 and the outer lateral surface of the outer sound-source-member wall 44 is less than the width between the inner lateral surface of the outer sound-source-member projecting wall 44 and the outer lateral surface of the inner enclosure projecting wall 59. However, the largest width between the inner lateral surface of the outer enclosure wall 58 and the outer lateral surface of the outer sound-source-member wall 44 is greater than the width between the inner lateral surface of the outer sound-source-member projecting wall 44 and the outer lateral surface of the inner enclosure projecting wall 59. Hence, substantially, the space between the outer sound-source-member and enclosure walls 44 and 58 is greater than the space between the outer sound-source-member wall 44 and the inner enclosure wall 59.

Furthermore, since each of the projecting walls 42, 44, and 59 has a thickness decreasing from the base to the rim thereof, the passageway 80 increases in width from the piezo-electric element 38 to the sound exits 68. The cross section of the sound passageway 80, in effect, spreads like a horn from the sound emitting portion to the sound exits 68 while the sound passes through the passageway 80. Therefore, as the sound spreads, the path broadens. Accordingly, the warning sound reflected in the passageway 80 spreads widely in the passageway 80 and is broadcast over a long distance.

As described above, the warning sound generating device has advantages as follows:

First, the cross section of the sound passageway 80 in effect spreads like a horn while the sound passes through the passageway 80. Therefore, as the sound spreads, the path broadens even after exit from the enclosure 22. The warning sound reflected in the passageway 80 may be broadcast over a long distance.

Second, since the passageway 80 is defined as a zigzag shape by the enclosure 22 and the sound-source-member 20, the passageway 80 can be relatively long while the whole device can be made compact. This advantage can be easily achieved since each of the projecting walls 42, 44, and 59 has a thickness decreasing from the base to the rim thereof. Accordingly, the warning sound generating device is of a small size while the sound passageway 80 is elongated even if the number of folds of the passageway 80 is limited. Furthermore, the passageway 80, the sound-source-member 20, and the sound generating circuit 21 are protected by the enclosure 22, so as not to be damaged.

Third, the projecting walls 42, 44, 59, which define the sound passageway 80, belong to the enclosure 22 or the sound-source-member 20. Consequently, the number of the components or elements is less than in any conventional siren or warning sound generator. Thus, in order to provide the sound passageway 80, the assembling does not require troublesome operations but instead the attaching of the enclosure 22 and the sound-source-member 20 is such that efficiency for assembling is improved. Further, even if the piezo-electric element 38 malfunctions, it is easy to repair the sound generating apparatus by replacing the sound-source-member by a new one comprising a new piezo-electric element. If necessary, intentional changing of the tone of the sound is easily achieved, by replacing the sound-source-member by another one comprising another piezo-electric element.

Fourth, the enclosure projecting walls 58 and 59, which open toward the sound-source-member 20, are mounted on the front wall 56 of the enclosure 22 unitedly or securely. The warning sound generator is of a strong construction in which undesirable change of tone of the generated sound will not occur.

What is claimed is:

1. A warning sound generating device comprising:

a sound-source-member for generating a warning sound, the sound-source-member having a planar base plate and at least a sound-source-member continuous projecting wall extending from a surface of the base plate, said sound-source-member projecting wall having a forward rim, and said planar base plate having a sound emitting portion surrounded by said sound-source-member projecting wall; and an enclosure means secured to the sound-source-member for containing and protecting said sound-source-member, the enclosure means including a front wall having an inner surface facing generally parallel to said surface of said planar base plate from which said sound-source-member projecting wall extends, the enclosure means being spaced apart from said forward rim of the sound-source-member projecting wall of the sound-source-member, the enclosure means further including at least a continuous enclosure projecting wall extending from said surface of the front wall toward said base plate of the sound-source-member, said enclosure projecting wall having a rearward rim spaced apart from the base plate, said enclosure projecting wall being disposed outward of said sound-source-member projecting wall and spaced apart from said sound-source-member projecting wall so as to form a space therebetween, the enclosure means having a plurality of sound exits formed outwardly from said enclosure projecting wall, whereby there is provided a sound passageway from said sound emitting portion of the sound-source-member through said space between said sound-source-member projecting wall and enclosure projecting wall to said sound exits.

2. A warning sound generating device according to claim 1, wherein said passageway has a width substantially increasing from the sound emitting portion to the sound exits.

3. A warning sound generating device according to claim 2, wherein said sound-source-member and enclosure means have a plurality of said sound-source-member projecting walls and said enclosure projecting wall projecting in an alternating fashion from the outermost projecting wall to the innermost projecting wall, from the sound emitting portion in such a manner that the outermost projecting wall is the outermost enclosure projecting wall.

4. A warning sound generating device according to claim 3, wherein said sound-source-member projecting walls stand generally perpendicularly to said surface of the base plate of the sound-source-member, and the inner enclosure projecting wall or walls of said enclosure projecting walls stand generally perpendicularly to said inner surface of the front wall, each of said sound-source-member projecting walls having a thickness decreasing from a base thereof to a forward rim, each of said inner enclosure projecting wall or walls having a thickness decreasing from a base thereof to the rearward rim, whereby said passageway has a width increasing from the sound emitting portion to the sound exits.

5. A warning sound generating device according to claim 4, wherein said sound emitting portion has a circular shape, each of said sound-source-member projecting walls and inner enclosure projecting wall or walls being of a cylindrical shape, and said sound-source-member projecting walls and said enclosure projecting walls are aligned generally concentrically.

* * * * *